United States Patent [19]

Davis

[11] 3,968,779

[45] July 13, 1976

[54] FUEL INJECTION PUMP AND INJECTION CONTROL SYSTEM THEREFOR

[75] Inventor: Charles W. Davis, Simsbury, Conn.

[73] Assignee: Stanadyne, Inc., Hartford, Conn.

[22] Filed: Feb. 11, 1975

[21] Appl. No.: 548,906

[52] U.S. Cl. ..... 123/140 FG; 123/139 AQ; 123/140 R

[51] Int. Cl.[2] ..... F02D 1/00; F02D 1/04

[58] Field of Search ..... 123/139 AQ, 140 FG, 123/140 R

[56] References Cited

UNITED STATES PATENTS

| | | | |
|---|---|---|---|
| 3,185,140 | 5/1965 | Cummins, Jr. | 123/140 FG |
| 3,557,765 | 1/1971 | Nystrom | 123/139 AQ |
| 3,598,097 | 8/1971 | Stuttgart | 123/140 FG |
| 3,633,559 | 1/1972 | Eheim | 123/139 AQ |
| 3,698,369 | 10/1972 | Vuaille | 123/140 FG |
| 3,771,506 | 11/1973 | Davis | 123/139 AQ |
| 3,910,724 | 10/1975 | Okamoto | 123/139 AQ |

*Primary Examiner*—Wendell E. Burns
*Assistant Examiner*—James W. Cranson, Jr.
*Attorney, Agent, or Firm*—Prutzman, Hayes, Kalb & Chilton

[57] ABSTRACT

A fuel injection pump with a control system for regulating the quantity and timing of the delivery of fuel to an associated engine is disclosed. In the control system, three pistons, slidably mounted in parallel bores, are provided. One of the pistons is powered so that it assumes an axial position indicative of engine speed. A second piston is powered to assume an axial position indicative of the quantity of fuel being delivered by the pump. The first and second pistons are each provided with a cam surface, and cam followers controlled thereby interconnect these pistons with the third piston to control the axial position of the third piston and the timing of delivery of fuel by the pump. A second cam surface on the speed positioned piston is connected to a variable stop which varies the maximum amount of fuel which can be delivered by the pump in accordance with speed and a second cam surface on the fuel quantity positioned piston actuates a feedback control to adjust the amount of fuel delivered by the pump so as to maintain the selected engine speed. Various additional modifying or override controls are provided to selectively modify the operation of the pump in accordance with other parameters, such as manifold air pressure, or during starting, or in case of malfunction.

37 Claims, 4 Drawing Figures

FUEL INJECTION PUMP AND INJECTION CONTROL SYSTEM THEREFOR

The present invention relates to fuel injection pumps for supplying discrete measured charges of liquid fuel to an internal combustion engine and more particularly to a rotary distributor fuel injection pump for a compression-ignition engine which incorporates an injection control system for controlling the quantity and timing of the injection of fuel in accordance with selected engine operation parameters.

The operation of compression-ignition engines involves a compromise of levels of power economy, smoke, gaseous emissions, and combustion noise and requires precise control of injection timing with engine speed, load and intake manifold air pressure, and precise control of the maximum quantity of fuel injected per stroke according to engine speed and manifold air pressure. A governing system that regulates fuel delivery with variations of load to control speed is also necessary. Emissions regulations complicate the control requirements and force some compromise. Nitrogen oxides emission regulations can generally only be met if injection timing is retarded somewhat from the maximum power setting when operating at and near maximum brake mean effective pressure (BMEP), the amount of retardation required depending on the operating speed. This reduces the maximum temperature developed during combustion and, therefore, the amount of nitrogen oxides formed. However, retarded timing also causes increased black smoke at high BMEP which may require reducing the amount of fuel injected, and if the same degree of retardation is continued at all speeds and loads, efficiency may be unnecessarily penalized, and misfire, incomplete combustion, white exhaust smoke and high unburned hydrocarbon emissions may occur at low load, particularly at low speed. The maximum quantity of fuel injected in turbo-supercharged engines must also be cut back during rapid acceleration from low load conditions to avoid puffs of black exhaust smoke because high manifold pressure is not developed instantaneously. Advancing injection timing during rapid acceleration from low manifold pressure conditions will, in some engines, reduce smoke with less fuel cutback and less power loss. Moreover, if a given injection pump is to be used on different engines with different timing and fuel quantity requirements, a very flexible control system is necessary.

Thus, it is desirable to provide an injection control system in which the timing of injection is controlled precisely in accordance with the speed, the load and the intake manifold air pressure to avoid the discharge of unwanted gaseous emissions into the atmosphere and it is a principal object of this invention to provide a fuel injection pump with such a control system.

It is another object of this invention to provide an injection pump control system whereby maximum fuel delivery per stroke is regulated in a manner that is variable with both speed and manifold air pressure.

A further object of this invention is to provide an improved speed governor regulation of which controls the maximum fuel delivery to the engine.

It is another object of this invention to provide a fuel injection pump having a continuously programmed control system for regulating the timing of injection in accordance with both speed and load in both the advance and retard direction. Included in this object is the provision of such a control system wherein the timing, quantity, and the varying maximum amount of fuel which can be delivered to the engine at varying speeds and loads are interdependent.

A further object of this invention is to provide a fuel injection pump having an automatically operated fuel shut-off valve which is independently responsive to loss of control signal, overspeed conditions and other malfunctions. Included in this object is the provision of the same fuel shut-off valve for normal fuel shut-off and for emergency shut-off.

Other objects will be in part obvious and in part pointed out more in detail hereinafter.

A better understanding of the invention will be obtained from the following detailed description and the accompanying drawing of an illustrative application of the invention.

Figure 1:
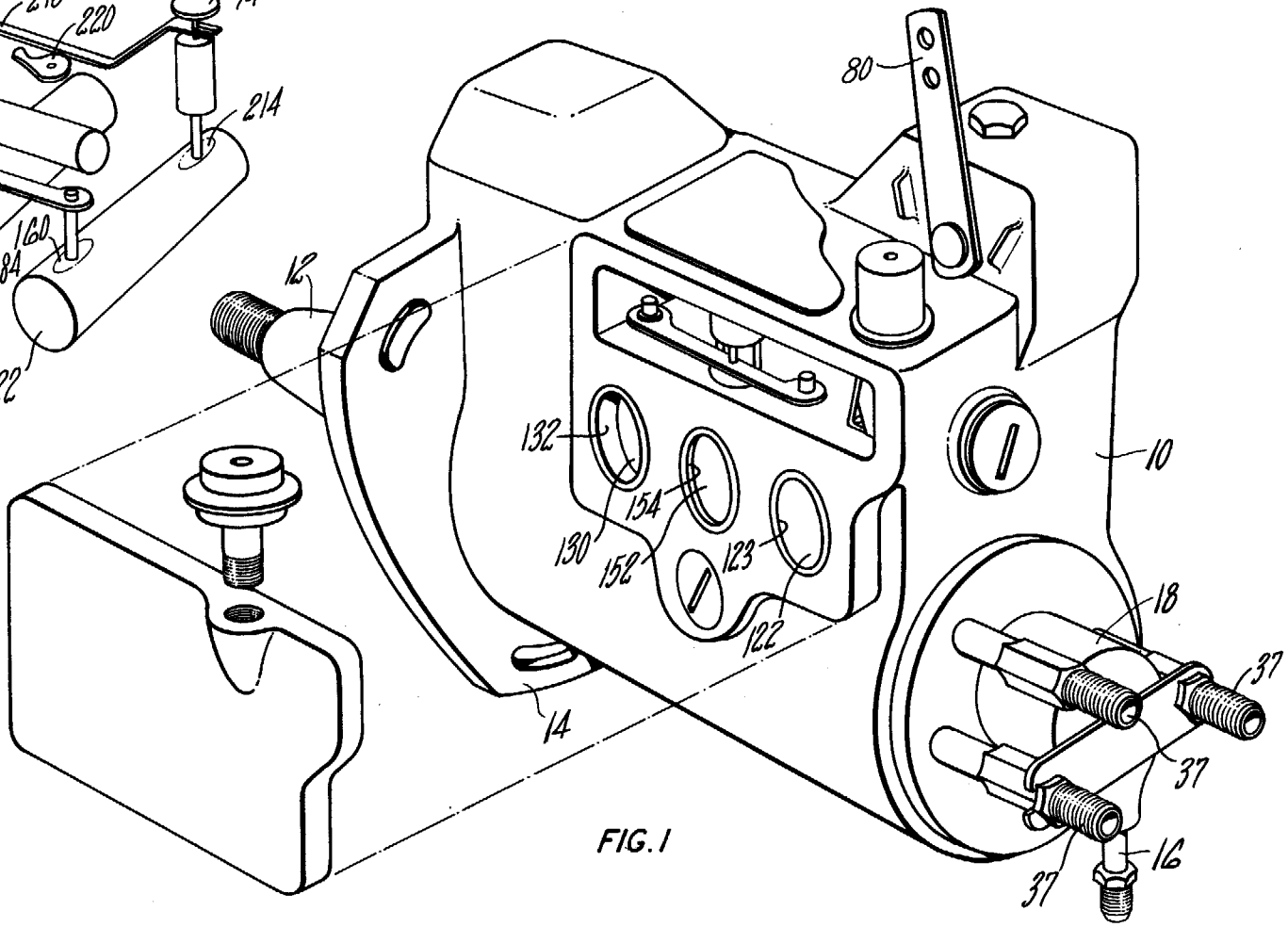
FIG. 1 is a partially exploded perspective view of an illustrative fuel pump incorporated in the present invention.

Referring now to the drawings, in which like numerals refer to like parts throughout the several figures, FIG. 1 represents a fuel pump suited for incorporating the injection control system of the present invention. As illustrated, the pump is of the rotary distributor type such as that of copending patent application Ser. No. 453,572, filed Mar. 22, 1974 and assigned to the assignee of the present invention which is particularly suited for the incorporation of the present invention.

The pump 10 mounts a distributor rotor 26 having a drive shaft 12 driven by an associated engine on which the pump is mounted by flange 14. The amount of fuel injected per stroke is regulated by partial rotation of ring 15 caused by axial motion of piston 122 as more fully disclosed in the aforesaid copending application. The timing of fuel injection is regulated by the angular position of cam ring 19 which is determined by the axial position of piston 152, such means being well known in the art.

Figure 3:
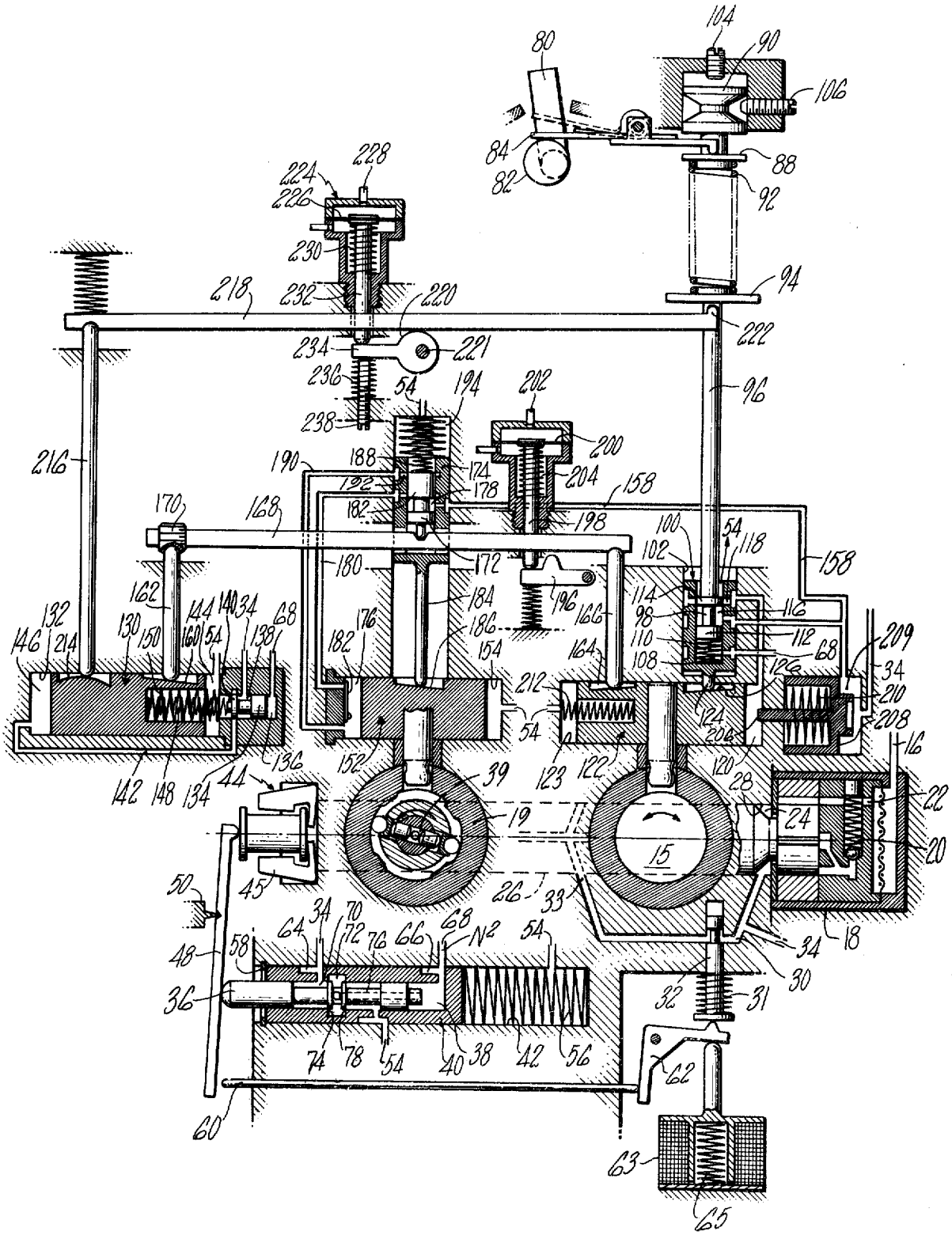
FIG. 3 is a schematic representation of a fuel control apparatus incorporating an illustrative embodiment of the present invention.

As shown in FIGS. 1 and 3, fuel enters the pump through an inlet 16 from a supply tank (not shown) and flows to a transfer pump 18 where it is pressurized to a pressure regulated by the spring biased pressure regulator 20 which recirculates dumped fuel through a passage 22 back to the inlet of the pump. The transfer pump 18 delivers its output to an annulus 24 formed by the distributor 26 and the bore 28 in which it is journaled.

From the annulus 24, the pressurized output of the transfer pump flows through passage 30 past a shut-off valve 32 to a charging port 33 of the rotary distributor 26 and to a charge pump 39 wherein charges of fuel are pressurized to high pressure and delivered to pump discharge conduits 37 (FIG. 1) through passages (not shown) in the usual manner. Fuel from passage 30 also flows through a branch passage 34 for delivery to the hydraulically powered actuators of the injection control system where it serves to provide the power for operating the actuators.

As shown in FIG. 3, transfer pump output pressure is delivered through the passage 34 to the inlet of a pressure generator including a pressure generator valve or plunger 36 slidably mounted in sleeve 40 for generating a pressure signal in the chamber 38 formed by the valve 36 and the sleeve 40 which in turn is slidably mounted in the bore 42. The pressure in the chamber 38 is regulated by centrifugal governor 44 having a plurality of centrifugal flyweights 45 which are mounted to rotate with the motor distributor 26 so that a centrifugal force which is correlated with the engine speed is exerted on the governor flyweights 45. It will be understood that the centrifugal flyweights 45 acting under the influence of centrifugal force will exert an axial force on the left end of valve 36 through a pivoted lever 48 which rocks on pivot 50. The axial force on the left end of valve 36 and the hydraulic force on the right end, due to the pressure in chamber 38, control the axial position of valve 36 relative to sleeve 40 so as to add fuel to the chamber 38 from passage 34, or dump fuel from chamber 38 through fuel passage 54 to a housing cavity wherein leakage fuel is maintained under a fixed low pressure and the excess is returned to the supply tank, thereby maintaining in chamber 38 a pressure which counter-balances the centrifugal force imposed on the flyweights 45 and accordingly produces a control pressure correlated with the square of engine speed ($N^2$).

If the pressure in the chamber 38 is less than that required to balance the axial force imposed on the valve 36 by the governor flyweights 45, the valve 36 is moved to the right, as viewed in FIG. 3 to connect annulus 70 with annulus 72 past land 74 so that fuel under pressure from passage 34 is delivered through axial passage 76 in the valve 36 to the chamber 38 until such time as the pressure in chamber 38 is at a level which balances the axial force produced on the valve 36 by flyweights 45. The valve is then moved left to its original position and the connection to annulus 70 is reclosed.

In a similar manner, if the axial force imposed by fly-weights 45 decreases, the valve 36 will move to the left due to the higher axial force produced by the fuel in the chamber 38 to spill fuel from the chamber 38 through axial passage 76 to annulus 72 and past land 78 to spill passage 54 until a condition is reached wherein the pressure in chamber 38 is sufficient to offset the axial force produced by flyweights 45.

The pressure in chamber 38 is thus maintained at a level correlated with the square of the speed ($N^2$) by the addition or spilling of fuel from the chamber 38 to provide a speed related hydraulic control signal. The $N^2$ pressure generated in chamber 38 is delivered by passage 68 to various units of the control system as indicated.

The sleeve 40 is biased toward a stop 58 by a preloaded spring 56 positioned in a chamber connected to the housing cavity through passage 54. The spring 56 serves as an overspeed spring and prevents, under normal operation, axial motion of sleeve 40 and the lever arm 48 of the governor from engaging the push rod 60. However, when the centrifugal force imposed on the governor flyweights 45 becomes excessive under overspeed conditions, the centrifugal force of flyweights 45 will compress the spring 56 moving valve 36 and sleeve 40 to the right so that the lever 48 engages the push rod 60 to cause the L-shaped lever 62 to depress shut-off valve 32 to close the passage 34 and prevent further fuel from being delivered by passage 30 to the rotary distributor for delivery to the engine. The inlet ports 64 and 66 respectively of the sleeve 40 are axially elongated to assure that the inlet passage 34 and the discharge passage 68 which delivers $N^2$ pressure to the control system of the pump are in continuous communication with the interior of sleeve 40 for maintaining the delivery of $N^2$ pressure under all operating conditions.

It will also be apparent that in the event of the collapse of $N^2$ pressure in chamber 38 for any reason, as for example a loss of supply pressure from the transfer pump 18, the valve 36 will bottom in chamber 38 causing the push rod 60 to pivot the lever 62 and shut off supply of fuel to the rotor through passage 30. Thus, the safe operation of the pump is assured in the event of the loss of control pressure in the chamber 38 independently of any overspeed condition.

The speed of operation is set by means of a hand throttle 80 which, as shown in FIG. 3, is provided with an eccentric 82 engageable with a pivoted lever 84 that is spring biased against the eccentric 82. The opposite end of the lever 84 engages a flange 88 of a throttle plunger 90 which serves as the seat for one end of governor spring 92. The other end of the spring 92 engages a spring seat 94 provided by a throttle rod 96 which in turn engages a spool valve 98 of a governor servo system, which also includes an axially slidable feedback sleeve 100 mounted in a bore 102, for regulating the axial position of governor piston 122 and thus the fuel delivered to the pump to maintain a preset speed as hereinafter more fully described.

An adjustable screw stop 104 is provided to adjust the upward movement of the throttle plunger 90 to set the minimum pressure applied to spring 92 to establish minimum engine speed. A second adjustable stop screw 106 is provided to adjust the maximum speed for the engine. The feedback sleeve 100 of the governor servo includes a closed chamber 108 which continuously communicates with the chamber 38 through passage 68, and therefore contains $N^2$ pressure which with the assistance of spring 110 establishes a biasing force acting in opposition to the biasing force of spring 92. It is apparent that the axial position of spool valve 98 of the governor servo will move in response to speed change until the force of spring 110 plus the force caused by the $N^2$ pressure within the chamber 108 exactly offsets the biasing force of governor spring 92. It will be understood that housing pressure adds a force on spool valve 98 to aid spring 92 a fixed amount.

The spool valve 98 is provided with an annulus 116 between two axially spaced cylindrical lands 112 and 114 respectively. The land 114 covers and uncovers the port 118 in feedback sleeve 100 to control the delivery of fuel to the chamber 120 of governor piston 122 from annulus 116 which is connected to conduit 34 via conduit 158. Similarly, land 114 controls the dumping of fuel from chamber 120 through port 118 to housing cavity 54 to control the axial position of governor piston 122 for controlling the quantity of fuel delivered to the charge pump 39 and to the associated engine. While governor piston 122 may be connected to any mechanism for metering the charges of fuel in charge pump 39, it is shown as being connected to a rotary ring 15 for controlling the fuel delivered by the pump in accordance with its axial position as more fully described in the aforementioned copending application.

It will be apparent that as engine speed decreases from the preset speed, the $N^2$ pressure generated in chamber 38 will also decrease. This in turn causes the pressure in the chamber 108 to reduce and the governor spring 92 moves the spool valve 98 of the governor servo downwardly relative to the surrounding sleeve 100 opening port 118. As a result, trapped fuel in the chamber 120 of the bore in which governor piston 122 is slidably mounted is dumped to the housing cavity through the port 118 so that the governor piston 122 moves to the right due to the force of spring 212. This causes the delivery of more fuel to the engine by the pump. Also, as a result of the movement of the governor piston 122 to the right, the feedback sleeve 100 of the governor servo is also moved downward due to engagement of cam surface 126 and follower portion 124, until land 114 again closes port 118 terminating motion of piston 122 with the system again in equilibrium at a slightly lower speed and at a higher load. If engine speed were to increase, upward motion of spool valve 98 due to higher pressure in chamber 108 causes land 114 to open port 118 to annulus 116 admitting transfer pump pressure to chamber 120 and causing piston 122 to move to the left decreasing fuel delivery and causing feedback sleeve 100 to move up so that land 114 again closes port 118. Accordingly, the position of the governor piston 122 is maintained at an axial position indicative of the quantity of fuel being delivered to the associated engine.

Figure 2:
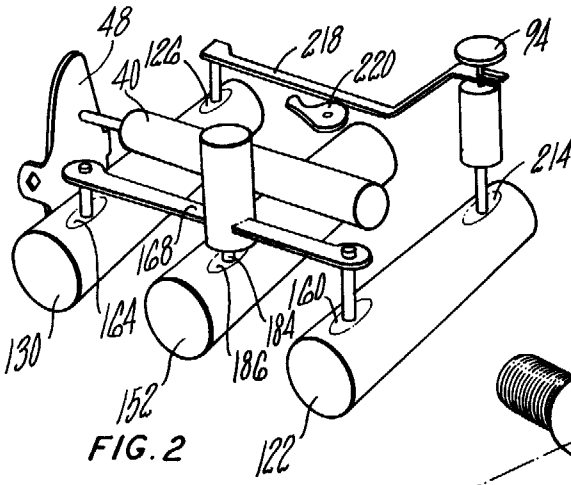
FIG. 2 is a perspective representation of the signal sensing reference pistons and interconnecting beams utilized in the practice of the invention.

The control system of this invention includes a second piston 130 which, as shown in FIGS. 1 and 2, is slidably mounted in a transverse bore 132 in the housing 10 of the pump which is parallel to the transverse bore 123 mounting the governor piston 122. Piston 130 is maintained at an axial position which is indicative of engine speed by a servo valve 134.

As shown, a chamber 136 at the end of the bore slidably mounting servo valve 134 receives $N^2$ pressure from the chamber 38 through passage 68. The output of the transfer pump is delivered by the passage 34 to the annulus 38 of the servo valve and the land 140 of the servo valve 134 serves to control communication between the passage 142 and the annulus 138 or housing chamber 144 depending upon the axial position of the servo valve 134. Piston 130 is biased to the left by spring 150 and servo valve 134 is biased to the right by spring 148 (inside spring 150) between piston 130 and servo valve 134.

It will be seen that as $N^2$ pressure increases due to an increase in engine speed, the pressure in the chamber 136 will move the servo valve 134 to the left as viewed in FIG. 3 compressing spring 148 to provide communication between passage 34 and passage 142 to deliver additional fuel to chamber 146. This causes the piston 130 to move to the right as viewed in FIG. 3 until land 140 recloses the passage 142 so that additional fuel is not delivered to, or dumped from, the chamber 146.

Similarly, servo valve 134 will be moved to the right by spring 148 as $N^2$ pressure in chamber 136 decreases due to a reduction in engine speed to spill fuel from the chamber 146 to the housing cavity through passage 142, chamber 144 and spill passage 54 so that torque piston 130 moves to the left under the bias of spring 150 and servo piston 134 follows until the port of passage 142 is reclosed.

Thus the torque piston 130 continuously assumes an axial position in its bore which is indicative of engine speed.

As indicated in FIGS. 1 and 2, a third piston 152 is shown as being disposed in parallel relationship with governor piston 122 and torque piston 130. Piston 152 is mounted in a transverse bore 154 in the pump housing 10 and its axial position is controlled to adjust the timing of high pressure pumping of the fuel by the charge pump 39 and hence the timing of injection of fuel into the associated engine.

As shown in FIG. 3, the axial position of advance piston 152 in its bore 154 determines the time of injection with movement of the advance piston 152 to the right indicative of earlier injection.

Torque piston 130 is provided with a shaped cam surface 160 engaged by cam follower 162. Governor piston 122 is similarly provided with a shaped cam surface 164 engaged by cam follower 166. The opposite ends of cam followers 162 and 164 engage the ends of a beam 168 to provide a continuously programmed control signal for regulating the timing of injection of fuel in accordance with both speed and load in both the advance and the retard directions. An adjusting screw 170 is provided to adjust the timing of injection and accommodate for manufacture variations and tolerances. A midpoint of advance beam 168 engages a servo valve 172 which is slidably mounted in an axially movable sleeve 174 for controlling the delivery of fuel from the transfer pump to the chamber 176 at the end of the bore in which advance piston 152 is slidably mounted, or the spill of fuel therefrom, to adjust the axial position of the advance piston and hence the timing of the injection. During operation, advance piston 152 is urged to the left by pumping reaction forces. Transfer pump output pressure is delivered to the servo valve 173 through a conduit 158 which communicates with the annulus 178 of the servo valve 172. It will be apparent that, in the embodiment illustrated, the servo valve 172 is moved upwardly when the torque piston 130 is moved to the right or the governor piston 122 is moved to the left in response to a higher speed or lower load condition and the annulus 178 will communicate with the passage 180 to deliver fuel under transfer pressure to the advance piston chamber 176 past one-way valve 182 causing piston 152 to move right and rotate the cam ring in a direction to advancce the timing of injection. This advance motion is terminated by the follow-up action of servo valve sleeve 174 which is provided with an actuator 184 engageable with a cam surface 186 on the advance piston to move the valve sleeve 174 upwardly until communication between the annulus 178 of the valve 172 and the passage 180 is cut off by the land 182.

Similarly, where the advance beam 168 moves downwardly due to a downward movement of either cam follower 162 or 166 as a result of movement of the torque piston 130 to the left or the governor piston 122 to the right, the servo valve 172 will move downwardly under the bias of spring 188 so that fuel may be dumped to the housing cavity from advance piston chamber 176 through passage 190, port 192, spill chamber 194 and spill passage 54. The movement of the advance piston 152 in the retard direction to the left, as shown in FIG. 3, will result in the downward movement of the sleeve 174 until equilibrium position is reached and the land 172 covers the port 192 to block further passage or spilling of fuel from the advance piston chamber 176.

If desired, means may be provided to advance the timing of injection at low manifold air pressure according to the level of the pressure. As shown, a spring biased pivoted stop 196 is normally held in an inoperative position by being spaced from advance beam 168 due to the opposing force offered by the plunger 198 connected to a diaphragm 200 which is subjected to manifold air pressure through conduit 202. It will be seen that when the manifold air pressure above the diaphragm 200 decreases to a prescribed level, the biasing spring 204 will raise the diaphragm plunger 198 upwardly until the pivoted stop 196 engages the advance beam 168 to override cam follower 166 in the control of the advance servo 172. Further decreases in manifold air pressure varies the position of the advance piston to advance the timing of injection in accordance with the level of the manifold air pressure.

Torque piston 130 is provided with a second cam surface 214 engaged by one end of a cam follower 216 which cooperates with torque beam 218 to translate the axial position of the torque piston 130 into a scheduled maximum variable fuel delivery by the pump in accordance with engine speed. As previously stated, the torque piston 130 is maintained in an axial position which is determined by engine speed and, by controlling the profile of cam surface 214, the axial position of cam follower 216 may be programmed to provide variations of maximum fuel delivery with speed as required by different engines.

The other end of the cam follower 216 engages one end of torque beam 218 which is pivoted on eccentric 220. The other end 222 of the torque beam 218 serves as a maximum fuel stop and is normally spaced from the spring seat 94 for the governor spring 92 at other than maximum delivery conditions so as not to interfere with the operation of the governor.

The position of ring 15, piston 122, feedback sleeve 100, spool valve 98, throttle rod 96, and spring seat 94 all maintain a fixed position relationship, one to the other, under hydraulic control, such that motion of piston 122 to the right, for more fuel, requires downward motion of spring seat 94. Thus, if down motion of spring seat 94 is limited by contact with stop 222, motion of piston 122 to the right and the amount of fuel injected per stroke is similarly limited. It is, therefore, apparent that cam profile 214 on torque piston 130 can be arranged to position stop 222 in a variable manner with speed and regulate maximum fuel delivery per stroke as desired according to speed.

As disclosed in FIG. 3, an aneroid device 224 is provided to modify the maximum fuel which may be delivered at varying engine speeds according to manifold air pressure conditions. As shown, the aneroid includes a diaphragm 226 which is subjected to the opposing biasing forces of manifold air pressure delivered through conduit 228 and biasing spring 230. The plunger 232 of the aneroid engages the control arm 234 of the eccentric pivot so as to rotate member 220 around supporting member 221 causing the pivot point for beeam 218 to move up with decreasing manifold pressure or down with increasing manifold pressure and causing a similar motion of stop 222 with a corresponding change in maximum fuel delivery per stroke. An adjustable stop 238 is provided for providing an absolute maximum fuel adjustment and a biasing spring 236 maintains the arm 234 in contact with plunger 232.

Since the aneroid 224 provides for the continuous adjustment of the pivot 220 in accordance with manifold air pressure and does not interfere with the operation of the torque beam in following the cam profile of cam 214 and the axial position of the torque piston 130, this arrangement maintains the shappe of the torque curve, i.e., the maximum variable fuel which may be provided to the engine at different speeds throughout the speed range but merely shifts the level of maximum fuel delivery in accordance with manifold air pressure. It is apparent that the aneroid mechanism could also be located to position a second variable stop under spring seat 94 in which case the operation of stop 222 would be superseded rather than modified.

As previously indicated, the governor lever 48 engages the push rod 60 to shut off the delivery of fuel to the distirbutor rotor and the charge pump under overspeed conditions against the bias of spring 56 and also upon the failure of the $N^2$ control signal due to a lapse of pressure in chamber 38 of the $N^2$ generator.

These independently functioning failsafe features are in addition to normal shut-off means. Valve 32 which is biased to open position by spring 31, will also be closed by action of stronger spring 65 if solenoid 63 is de-energized.

The embodiment of FIG. 3 provides excess fuel for starting and retarded timing of injection for starting. Governor piston 122 is normally free to move further in the maximum fuel direction than would be permitted by stop 222 under conditions of hydraulic control, and at cranking speed spring 212 forces piston 122 to an extreme right position, independent of governor servo action, because transfer pressure at this speed is not sufficient to oppose spring 212. This action provides greater than normal fuel delivery at cranking. A movable stop 206 for piston 122 serves to limit the amount of extra fuel at cranking when it is in the extreme right position, and when it is in the left position, serves as a safety stop to prevent gross over-fueling during normal operation in the event of hydraulic malfunction of the governor. The location of stop 206 is determined by transfer pressure. Transfer pump output pressure delivered by conduit 34 overcomes the bias of spring 210 during normal operation of the pump. During starting, however, the transfer pump output pressure is low and does not exceed the biasing force of spring 210, so that the piston 208 and the movable stop 206 are to the right bottoming and sealing against the end of chamber 209, thereby cutting off flow in conduit 158, which normally delivers fuel at transfer pump output pressure to power advance piston 152 and the governor piston 122. As a result, the advance piston 152 is moved to its full retard position during starting and governor piston 122 cannot be moved out of the excess fuel position until conduit 34 is reopened. When the engine has accelerated to about midspeed, transfer pressure acting on only the small inner area of the end of piston 208 will be sufficient to overcome the biasing force of spring 210 and piston 208 will move to the left. After piston 208 has moved to the left, transfer pressure acting on the full diameter will hold it in this position until the engine is substantially stopped.

Figure 4:
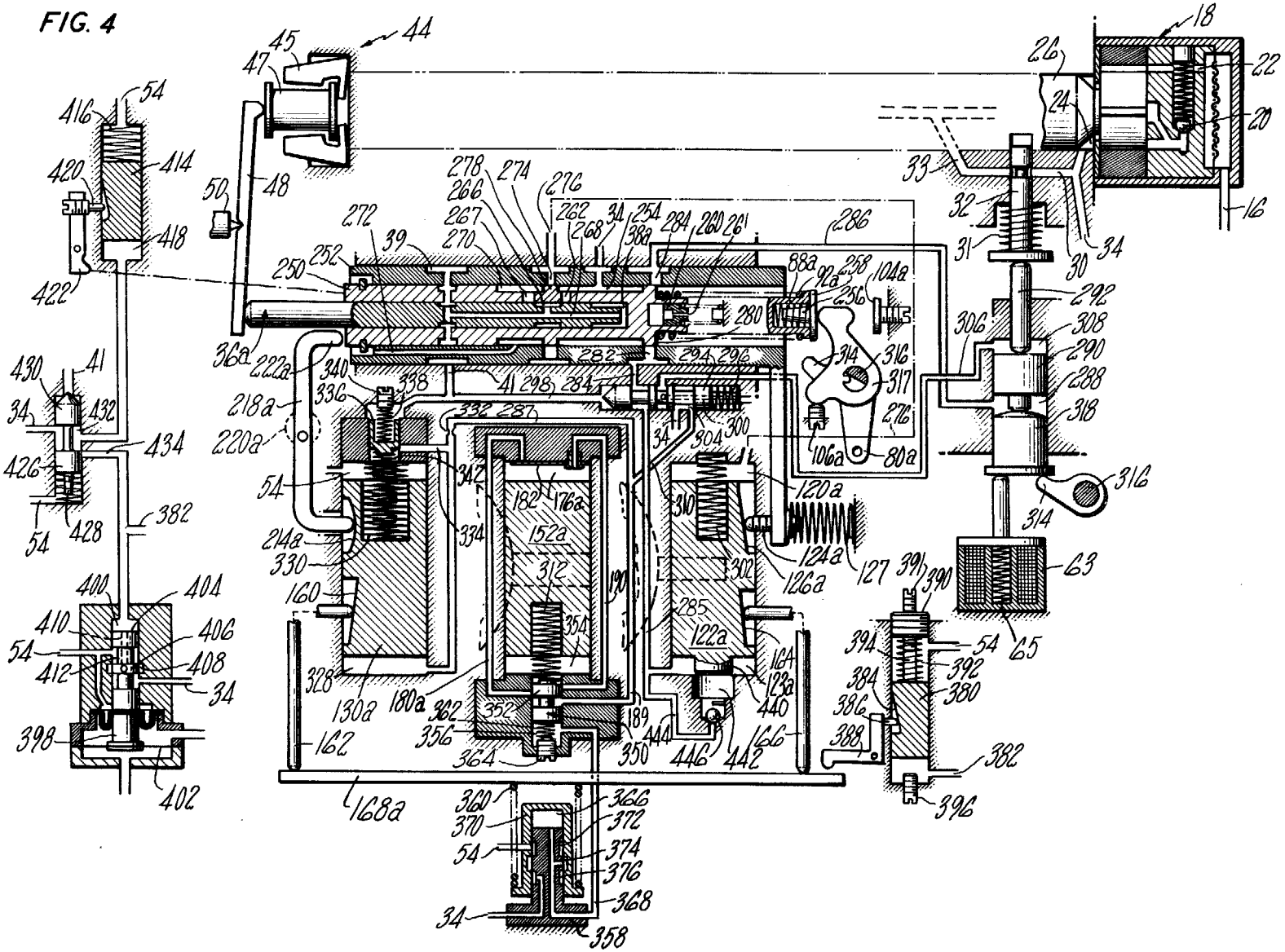
FIG. 4 is a view similar to FIG. 3 of another preferred form of the invention.

FIG. 4 illustrates another embodiment of the invention.

In FIG. 4, fuel enters the inlet 16 of a transfer pump 18 where it is pressurized to a pressure regulated by the spring biased pressure regulator 20 which recirculates dumped fuel to the passage 22 to the fuel inlet. Transfer pump 18 delivers fuel to an annulus 24 of the rotary distributor 26 from whence it is delivered through a passage 30 past a shut-off valve 32 to a rotor charging port 33. In the rotor 26, measured charges of fuel are sequentially pressurized to a high pressure and sequentially delivered to a plurality of fuel injection nozzles for the various cylinders of the associated engine as more fully disclosed and described in connection with the embodiment of FIG. 3.

As shown in FIG. 4, the output of the transfer pump is delivered by passage 34 to annulus 254 and the inlet port 262 for a pressure generator valve designated as 36*a*, which is slidably mounted within governor servo valve 250 and cooperates therewith to generate a pressure in the chamber 38*a* which is correlated with engine speed. Governor servo valve 250 is slidably mounted in the bore of a governor feedback sleeve 252. The passage 34 is provided with continuous communication with an annulus 254 formed between governor servo valve 250 and feedback sleeve 252. Axial motion of servo valve 250 with respect to feedback sleeve 252 causes opening and closing of ports that control the flow of fuel to and from chambers at both ends of governor piston 122*a*, thereby controlling its axial position and the amount of fuel injected. Servo valve 250 is urged left toward generator valve 36*a* by governor spring 92*a*.

A centrifugal governor 54 has a plurality of flyweights 45 which are mounted to rotate with the rotary distributor 26 to produce a centrifugal force which is proportional to the square of the engine speed ($N^2$) and exert a force on the left end of valve 36*a* through a pivoted lever 48 which rocks on pivot 50.

Ports 267 and 262 in governor servo valve 250 and annular groove 266 in generator valve 36*a* act to admit fuel at transfer pump pressure in annulus 254 to chamber 38*a* or vent fuel from chamber 38*a* to annulus 270 at pump housing pressure so as to maintain a pressure in chamber 38*a* and a resulting force on the adjacent end of valve 36*a* that exactly opposes the force applied to the opposite end of valve 36*a* by lever 48. The process is the same as described for the embodiment of FIG. 3. During normal operation, pressure generating valve 36*a* and governor servo valve 250 operate as a unit in substantially fixed relationship to each other. Relative motion occurs only during flyweight force change and is limited to the small amount necessary to open or close the feed and spill ports. The $N^2$ pressure generated is also dependent on flyweight attitude, but at a given attitude, is proportional to the square of speed. Housing pressure is assusmed to be zero in this description; positive values for housing pressure will increase the generated pressure by an equal amount.

A hand throttle lever 80*a* is pivotally mounted by shaft 316 to apply biasing force on governor spring 92*a* through link 317, idle spring support 258, a cup-shaped spring seat 88*a* and an idle spring 256 having a low spring rate so that the spring seat 88*a* bottoms on idle spring support 258 above idle speed conditions. A pair of adjustable throttle stops 104*a* and 106*a* are provided to limit the range of biasing forces imposed on the governor spring 92*a* and adjust low and high operating speed limits respectively. Link 317 is positively rotated by shaft 316 only in a counter-clockwise direction by an internal tab engaging a flat on throttle shaft 316.

A spring biased dash pot 260 having a bleed aperture 261 is slidably received in a closed bore at the end of governor servo valve 250 to dampen any oscillations thereof.

During equilibrium operation, the governor spring force applied to governor servo valve 250 is resisted by flyweight force through the interaction with pressure generating valve 36*a*. Governor piston 122*a* is held in the axial position required to deliver the fuel necessary for this operating condition by a balance of the force due to the pressure in chamber 123*a* at one end of piston 122*a* and the force due to the pressure in chamber 120*a* plus the force of spring 302 at the other end.

Chamber 123*a* is connected to port 282 in feedback sleeve 252 by conduit 285, and changer 120*a* is connected to port 274 in the feedback sleeve by conduit 276. Ports 282 and 274 are opened or closed in unison to either transfer pressure in annulus 254 or housing pressure by a pair of lands 278 and 280 on governor servo valve 250. When one port is open to transfer pressure, the other is open to housing.

If the speed of the engine decreases, or if the throttle lever 80*a* is moved to apply more force to spring 92*a*, governor servo 250 and pressure generator valve 36*a* will move to the left causing port 274 to be opened to transfer pressure and port 282 to be opened to housing. Fuel will flow into chamber 120*a* and out of chamber 123*a* and piston 122*a* will move down to a position of greater fuel delivery. As piston 122*a* moves down, the action of follower 124*a* engaging cam surface 126*a* due to the force of spring 127 will cause feedback sleeve 252 to move left and reclose ports 282 and 274 restoring equilibrium at the new operating condition. An increase in engine speed or motion of throttle lever 80*a* to reduce the force of spring 92*a* will cause governor servo 250 to move right, port 274 will be opened to housing and port 284 will be opened to transfer pressure causing the reverse motion sequence of governor piston 122*a* and feedback sleeve 252 and stabilized operation at a lesser fuel delivery. Thus, the embodiment of FIG. 4 provides for positively powering the governor piston 122*a* in both directions.

Port 274 and conduit 276 can be omitted with chamber 120*a* connected to the housing cavity and the force of spring 302 increased, if desired, to provide a simpler, but substantially equivalent, functioning construction.

The embodiment of FIG. 4 also provides hydraulically actuated shutdown protection in the event that governor piston 122*a* or feedback sleeve 252 fail to respond properly, and speed higher than that called for by the position of throttle lever 80*a* occurs. If opening of ports 274 and 282 by motion of governor servo valve 250 to the right fails to cause a corresponding motion of feedback sleeve 252, valve 250 will move further to the right with respect to sleeve 252 causing land 280 to open port 284 to transfer pressure in annulus 254. Transfer pressure will be fed to chamber 288 in the shut-off mechanism. Piston 290 will move up causing member 292 to push shut-off valve 32 closed against the force of spring 31 closing passage 30 to prevent further flow of fuel to rotor charging port 33.

The embodiment of FIG. 4 also provides excess fuel for starting. An excess fuel valve 294 which is shown in the position it assumes under normal operation is biased by spring 296 to close the end of a passage 298 which contains $N^2$ signal pressure when the engine is stopped. Under starting conditions, the $N^2$ pressure is small and inadequate to unseat the excess fuel value from passage 298 so that passages 284 and 285 are not connected and fuel in chamber 123*a* at the end of governor piston 122*a* is spilled to housing pressure through axial passage 300 to permit the biasing spring 302 for the governor piston to bottom the governor piston to provide maximum fuel for starting regardless of the maximum fuel setting of the torque control system described later. As the $N^2$ pressure in the passage 298 reaches a level sufficient to overcome the bias of spring 296 acting only on the area of passage 298, the excess fuel valve 294 is moved to the right to its normal operating position to provide communication between passages 284 and 285 for the normal operation of the governor piston 122*a*.

Transfer pressure is applied to annulus 304 on the excess fuel valve through conduit 34. When the valve is moved to the left by bias spring 296 to close passage 298 under starting conditions, annulus 304 communicates with conduit 306 which in turn communicates with chamber 308 to act on the end of excess fuel shut-off plunger 292. Thus, in the event the excess fuel valve 294 sticks in its left position to prevent the hydraulic control of the governor piston 122*a* to limit the fuel due to the absence of communication between conduit 284 and 285, transfer pump output pressure will serve to close shut-off valve 32. The diameter of plunger 292 and the load of spring 31 are such that valve 32 will be closed at a desired engine speed such as, say, 1500 RPM.

The excess fuel valve also serves to assure that the advance piston will be in full retard position during starting and that leakage of transfer pressure at the advance mechanism and torque control mechanisms will be prevented during starting.

Passage 310 which delivers transfer pump output pressure from annulus 304 to chamber 176*a* to power the advance piston 152*a* in the advance direction and to connecting passage 287 supplying torque piston 130*a* are isolated from annulus 304 by the excess fuel valve 294 during starting conditions when spring 296 biases the excess fuel valve to the left. Thus, transfer fuel pressure cannot be delivered to chamber 176*a* to move the advance piston to an advanced position against the bias of spring 312, and fuel leakage is minimized during cranking when transfer pump capacity is critical.

As shown in FIG. 4, the shut-off valve 32 in addition to being operated automatically under certain conditions of malfunction as described above may also be operated by the electrical solenoid 63 as described in connection with the embodiment of FIG. 3 as well as directly and manually by virtue of an arm 314 connected to throttle shaft 316 with the arm 314 directly engaging an actuator 318 to depress the shut-off valve 32 and close the passage 30, when throttle lever 80*a* is moved closed beyond the idle speed setting.

As with the embodiment of FIG. 3, the torque piston 130*a* is slidably mounted in a bore and assumes an axial position which is correlated with engine speed. As shown in FIG. 4, the torque piston 130*a* will move upwardly at higher speeds and downwardly at lower speeds. It is biased downward by spring 330.

Transfer pump output pressure is provided to power torque piston 130*a* against the bias of spring 330 being delivered by conduits 310 and 287 to chamber 328 through restrictor 332. Downstream of restrictor 332 is a branch passage 334 delivering fuel to servo valve 336 which controls spill flow to chamber 54 at housing cavity pressure. The amount of fuel spilled by servo valve 336 controls the pressure in passage 334 and chamber 328 because of pressure drop over restrictor 332.

Spring 342 which is inside spring 330 is interposed between servo valve 336 and torque piston 130*a*. $N^2$ pressure from passage 41 is applied to the upper end of valve 336 and opposes spring 342. Spring 338 also exerts a force on valve 336, however, it simply counterbalances a portion of the force of spring 342 and is used simply for convenient adjustment of the net force of spring 342 using adjusting screw 340.

If engine speed increases, $N^2$ pressure increases moving valve 336 down against spring 342 reducing or momentarily stopping spill flow from passage 334 and causing a higher pressure in chamber 328. Torque piston 130*a* is, therefore, moved upward against spring 330 moving servo valve 336 upward and increasing spill flow from passage 334 until the pressure in chamber 328 is at the value required to hold piston 130*a* at this new position and equilibrium is restored. If speed decreases, $N^2$ pressure is reduced, valve 336 moves up to spill more fuel, the pressure in chamber 328 is lowered, piston 130*a* moves down and servo 336 moves down adjusting spill flow to maintain the lower pressure in chamber 328. The piston 130*a* is thereby accurately adjusted to an axial position indicative of speed.

Torque piston 138 has a cam surface profiled to establish, at each speed of the engine within the operating range, the maximum fuel which may be delivered by the pump regardless of the load imposed on the engine. The profile of cam surface 214*a* is translated to the maximum fuel setting by a pivoted lever 218*a* having an arm 222*a* which is normally spaced from the governor servo valve 250.

As the cam follower 218*a* engages the profile of cam surface 214*a*, the opposite end of the pivoted torque beam 218*a* will serve to limit the maximum movement of the governor servo valve 250 to the left in a manner which is correlated with engine speed. Since during normal, steady state operation servo valve 250, feedback sleeve 252 and governor piston 122*a* are all maintained in fixed relative position to each other, limiting the motion of servo valve 250 to the left is equivalent to limiting motion of governor piston 122*a* in the down or maximum fuel direction.

The pivot for the torque beam 218*a* is an eccentric 220*a* that is provided to permit adjustment of the entire maximum delivery versus speed curve upward or downward without affecting its shape. It will be apparent that the torque beam 218*a* is inactive except when it engages the end of governor servo valve 250 to limit the maximum fuel delivered to the engine when the engine is calling for more fuel in order to maintain speed.

The embodiment of FIG. 4 further includes an advance piston 152*a* which fixes the timing of injection in accordance with engine speed and load, and intake manifold air pressure.

As shown, transfer fuel output pressure is delivered by conduit 310 and conduit 189 to the advance servo shown generally as mechanism 350 having a servo valve 352 which controls the delivery of transfer pump output pressure to the chamber 176*a* through passage 180*a* past one-way valve 182, or from chamber 176*a* via passage 190 to chamber 354 at housing pressure.

The position of advance servo valve 352 is controlled by the pressure in chamber 356 at one end and the opposing force of spring 312 located between the other end of valve 352 and advance piston 152*a*. Spring 362 in chamber 356 serves only as a convenient trimmer for spring 312.

An increase in the pressure in chamber 356 moves valve 352 up admitting transfer pressure to chamber 176*a* and causing piston 152*a* to move down and advance pump timing and also moving valve 352 down until the port to passage 180*a* is reclosed. A lower pressure in chamber 356 causes a down motion of valve 352 with fuel spilled from chamber 176*a* causing upward retarding motion of piston 152*a* until resultant upward motion of valve 352 terminates spill flow from passage 190. Piston 152*a* is always urged in the retard direction by pumping forces on the cam ring. An increase in pressure in chamber 356 causes pump timing to advance and a decrease causes retard.

If $N^2$ pressure from annulus 39 were connected (not shown) to chamber 356, injection timing would advance with increasing speed and retard with decreasing speed.

FIG. 4 shows an advance pressure generator mechanism which generates a pressure for use in advance servo chamber 356 that is a function of both speed, load and manifold air pressure, in a programmable manner.

Closed end servo sleeve 370 fits over a cylindrical portion of fixed member 358 and communicating passages 372, 374, and 376 therebetween admit transfer pressure to chamber 366 or spill fuel therefrom so that the force on sleeve 370 due to the pressure in chamber 366 equals the force exerted on sleeve 370 by spring 360. The mechanism functions in the same manner as described previously for other servo systems.

The pressure in chamber 366 will be proportional to the force in spring 360 and since chamber 366 is directly connected to advance piston servo chamber 356 by passage 368, the position of advance piston 152*a* is proportional to the load of spring 360, pump timing advances with increased load of spring 360.

Spring 360 is biased against servo sleeve 370 by beam 168*a* which is positioned by followers 162 and 166 engaging cam surfaces 160 and 164 on torque piston 130*a* and governor piston 122*a* respectively. The shape of cam surfaces 160 and 164 and motion of pistons 130*a* and 122*a* will regulate the force exerted by spring 360. It will be apparent that motion of torque piston 130*a* up with increasing speed or motion of governor piston 122*a* up with decreasing load will cause spring 360 to become more compressed and, therefore, cause motion of piston 152*a* in the advance direction.

As shown in FIG. 4, means are also provided to control the advance piston movement in accordance with manifold air pressure. A spring biased advance override piston 380 is slidably mounted in a bore and is subjected to a control pressure received from an aneroid actuated servo valve through a passage 382.

The advance override piston 380 is provided with a cam surface 384 which is engaged by the cam follower 386 of the pivoted lever 388 to serve as an adjustable stop and override follower 166 limiting the upward movement of the right end of advance beam 168*a*.

An adjustable screw 390 is provided to adjust the bias of the spring 392 and an adjustable stop 391 is provided to adjust the relative position of cam 384 with respect to cam follower 386. A second adjustable stop 396 is provided to establish the level at which the manifold air pressure is effective for overriding the governor piston in controlling the timing of injection.

The manifold air pressure acts on a diaphragm for operating servo valve 398 to generate a balancing control pressure in the chamber 400 in accordance with the relative areas of the diaphragm 402 and the end 404 of servo valve 398. Transfer pump output pressure delivered by passage 34 is applied to control pressure chamber 400 when manifold pressure on diaphragm 402 raises the aneroid servo valve 398 upwardly to provide communication between passage 34 and control pressure chamber 400 past land 406, annulus 408, and axial passage 410 which communicates with the annulus as indicated until the pressure delivered to the chamber 400 exerts a force to equal the force exerted by the manifold pressure acting on the diaphragm 402 and blocks the communication between passage 34 and chamber 400. Similarly, a reduction of manifold air pressure results in a lowering of the aneroid servo valve 398 to dump trapped fuel in control pressure chamber 400 to housing pressure passage 54 through axial passage 410, annulus 408, and annulus 412. Control pressure will, therefore, be proportional to manifold pressure.

The control pressure generated in chamber 400 by the manifold air pressure also acts on a fuel cut-back piston 414, the axial position of which is controlled by the opposing forces of biasing spring 416 and the control pressure in chamber 418. When the control pressure from chamber 400 of the aneroid servo valve communicates with chamber 418, a reduction in the control pressure which accompanies a reduction of the manifold air pressure will permit the biasing spring 416 to move the fuel cut-back piston 414 downwardly so that its cam surface engages the adjustable cam follower 420 of pivoted cam lever 422 which is a movable stop to limit the left hand movement of governor servo valve 250.

A lockout valve 426 is provided to isolate the control signal from chamber 400 of aneroid servo valve from the fuel cut-back piston 414 and apply transfer pressure to chamber 418 to prevent fuel cut-back during starting.

The $N^2$ pressure signal in annulus 39 is delivered by passage 41 to an axial passage communicating with the end of lockout valve 426 to open the valve at a predetermined engine speed. Seating of valve 430 in passage 41 prevents $N^2$ pressure from acting on the full diameter of valve 430. Upon the movement of the lockout valve 426 due to a sufficiently high level of the $N^2$ pressure at passage 41, the valve 426 is moved down until its stop 428 bottoms against the end wall of the bore for the lockout valve. At this time, the valve 430 blocks passage 34 which previously delivered transfer pump pressure to the annulus 432 and chamber 418. Concurrently, passage 434 containing control pressure from the aneroid pressure chamber 400 communicates with chamber 418 of the fuel cut-back piston through annulus 432 of the lockout valve so that manifold air pressure is effective to control the fuel cut-back piston according to manifold air pressure and thereby override the torque beam 220*a* to limit the maximum fuel delivery when manifold pressure is low.

The delivery of the higher transfer pump output pressure to control the position of fuel cut-back piston 414 at low speeds holds the fuel cut-back piston 414 at its inoperative position at starting speeds while enabling manifold air pressure to provide an override to control the maximum fuel which is delivered by the pump after the lockout valve 426 is actuated by the $N^2$ pressure signal. In this regard, it should be understood that the lockout valve is designed to operate at a higher pressure than excess fuel valve 294 so that the excess fuel valve comes into operation prior to the lockout valve 426 to actuate the safety shut-off valve 32 as described above. After the lockout valve has opened, it will not reclose until the engine has substantially stopped because $N^2$ pressure now acts on the full diameter of valve 430.

FIG. 4 also discloses dampening means for governor piston 122*a* to slow down the rate at which fuel delivery can be increased near full load on turbo-supercharged engines. This arrangement is an alternate means to prevent puffs of black exhaust smoke that would otherwise occur during rapid acceleration from low load operating conditions because the build up of manifold air presure is delayed until the speed of the supercharger increases. The delivery of the extra fuel that can be burned with the extra air supplied by the supercharger is delayed until the extra is available.

Damper piston 440 protrudes from governor piston 122*a*. As piston 122*a* moves downwardly to a position correlated with a higher fuel delivery, damper piston 440 enters damper chamber 442 at some predetermined level of fuel delivery. Thereafter, the rate at which fuel delivery can be increased will depend on the leakage clearance around damper piston 440. Fuel cannot flow from chamber 442 into passage 444 which connects with passage 285 and chamber 123*a* because of one-way valve 446. Motion of piston 122*a* towards a lower fuel delivery position is not dampened when piston 440 is in chamber 444 because fuel can flow freely into chamber 442 from passage 444 past one-way valve 446.

From the foregoing, it is apparent that this invention provides for a versatile programmed control system which is readily adapted to the full control of any fuel pump while incorporating integrated andn independent failsafe safety features in the event of malfunction. Moreover, by shaping the profiles of cam surfaces, the design is adapted for full scheduled and programmed controls to meet the requirements of a wide variety of engines.

As will be apparent to persons skilled in the art, various modifications, adaptations and variations of the foregoing specific disclosure can be made without departing from the teachings of the present invention.

I claim:

1. A fuel injection pump for delivering measured charges of fuel under high pressure to an associated engine comprising, a source of fuel under pressure, a charge pump connected to receive fuel from said source and pressurize the fuel to high pressure, and a control system for regulating the charges of fuel and their delivery to the engine; said control system including injection timing means for controlling the timing of delivery of fuel by the charge pump, first and second pistons, actuating means for actuating the first piston to a position indicative of engine speed and for actuating second piston independently of the first piston to a position indicative of the quantity of fuel in each charge of fuel delivered by the charge pump, and means interconnecting said pistons with each other and with said injection timing means for controlling the timing of injection according to the positions of the first and second pistons.

2. A fuel injection pump according to claim 1 wherein said actuating means includes means for selectively supplying fuel from said source to actuate said pistons.

3. A fuel injection pump according to claim 2 wherein said actuating means includes means for generating a control signal indicative of engine speed.

4. A fuel injection pump according to claim 3 wherein the control signal generating means comprises a mechanical governor, a slidable plunger acting on a quantity of fuel in a chamber and means interconnecting said governor and said plunger for applying an axial force to said plunger whereby the pressure in said chamber is regulated to counter-balance the axial force applied to said plunger by said mechanical governor.

5. A fuel injection pump according to claim 4 wherein said plunger is slidably mounted in a sleeve to form said chamber and said sleeve is slidably mounted in a bore of said pump.

6. A fuel injection pump according to claim 4 including a passage for the delivery of fuel to said charge pump from said source, a shut-off valve in said passage, and automatic means responsive to the loss of control pressure in said chamber to close said shut-off valve.

7. A fuel injection pump according to claim 6 wherein said means interconnecting said governor and said plunger actuates said shut-off valve to close the same during overspeed conditions.

8. A fuel injection pump according to claim 5 including a passage for the delivery of fuel to said charge pump from said source, a shut-off valve in sid passage, and a hydraulic actuator operatively connected to said shut-off valve, wherein said sleeve serves as a valve to connect said source to said hydraulic actuator to close said shut-off valve upon the over-travel of said sleeve in its bore in the event that engine speed exceeds a preset level.

9. A fuel injection pump according to claim 1 wherein said injection timing means comprises a third piston and said interconnecting means controls a valve for controlling the actuation of said third piston.

10. A fuel injection pump according to claim 9 wherein said first and second pistons are each provided with cam surfaces, said interconnecting means comprises a beam having the lateral position of its ends controlled by the profiles of said cam surfaces, and means responsive to the lateral position of an intermediate point of said beam is provided to control the injection timing means.

11. A fuel injection pump according to claim 10 wherein said means responsive to the lateral position of said intermediate point of said beam is a servo valve which controls the delivery of fuel from said course for powering said third piston.

12. A fuel injection pump according to claim 10 wherein said means responsive to said intermediate point of said beam is a pressure generator which generates a hydraulic pressure signal for controlling the actuation of said third piston.

13. A fuel injection pump according to claim 3 including a servo valve responsive to said generated control signal for controlling said servo valve to regulate the supply of fuel from said source and automatically actuate said first piston to a position indicative of engine speed.

14. A fuel injection pump according to claim 1 including a governor servo valve to regulate the quantity of fuel delivered per stroke of the charge pump.

15. A fuel injection pump according to claim 14 wherein said first piston is provided with a cam surface having a cam follower engageable therewtih, said cam follower translating the profile of said cam to provide a movable stop for said servo valve thereby regulating maximum fuel delivery per stroke of said charge pump according to engine speed.

16. A fuel injection pump according to claim 15 wherein said cam follower comprises a pivoted beam engageable with said servo valve to limit the movement thereof.

17. A fuel injection pump according to claim 16 wherein said pivoted beam is mounted on an adjustable pivot to adjust the maximum fuel to be delivered per stroke of the charge pump.

18. A fuel injection pump according to claim 17 including means responsive to manifold air pressure for controlling the adjustment of said pivot.

19. A fuel injection pump according to claim 14 including means responsive to manifold air pressure to actuate a movable stop for said servo valve thereby to regulate the maximum fuel delivery per stroke of said charge pump according to the level of manifold air pressure.

20. A fuel injection pump according to claim 15 including means for generating a control signal correlated with the manifold air pressure of the engine and a fuel cut-back piston operable in response to said control signal, said fuel cut-back piston having a cam surface engaged by a cam follower for controlling a second movable stop for limiting the axial movement of said servo valve to limit the maximum fuel delivered by the pump.

21. A fuel injection pump according to claim 20 including a lock-out valve for controlling the supply of fuel from said source to actuate said fuel cut-back piston to render said movable stop inoperative during the starting of the engine until a prescribed engine speed is reached, said lock-out valve being locked in an operative position thereafter until the engine is substantially stopped.

22. A fuel injection pump according to claim 14 including means responsive to manifold air pressure to actuate a movable stop for said servo valve thereby to regulate maximum fuel delivery per stroke of said charge pump according to manifold air pressure.

23. A fuel injection pump according to claim 10 including means responsive to manifold air pressure to actuate a movable stop to provide an override control for the lateral position of the end of said beam controlled by the said second piston to control the actuation of said third piston thereby to control the timing of the pumping stroke of said charge pump according to the level of manifold air pressure.

24. A fuel injection pump according to claim 5 wherein a governor responsive valve controls the supply of fuel from said source to actuate said second piston to return the engine to preset speed upon any departure therefrom, said second piston having a first cam surface and a cam follower engageable therewith to provide a feedback signal for closing said valve when preset speed is re-established.

25. A fuel injection pump according to claim 24 wherein said slidably mounted sleeve is mounted in a second slidably mounted sleeve actuated by said cam follower, said sleeves forming said governor responsive valve to control the supply of fuel from said source to actuate said second piston upon relative axial movement of the sleeves.

26. A fuel injection pump according to claim 25 wherein the cam follower is held in engagement with said first cam surface to close the governor responsive valve upon the return of engine speed to its preset level.

27. A fuel injection pump according to claim 24 including second valve means operable by said generated control signal indicative of engine speed for isolating said source of fuel under pressure from said second piston during the starting of the engine and means for biasing said second piston to a position indicative of maximum fuel irrespective of other control signals.

28. A fuel injection pump according to claim 27 including a shut-off valve for stopping the flow of fuel through the pump and a hydraulic actuator therefor, said second valve means being effective to provide communication between said source of fuel under pressure and said hydraulic actuator to close the shut-off valve in the event of malfunction of said second valve means.

29. A fuel injection pump according to claim 27 wherein said second valve means isolates said injection timing means from said source of fuel under pressure whereby it is positioned in maximum retard position.

30. A fuel injection pump according to claim 27 wherein said second valve means renders the actuating means for said piston and said injection timing means inoperative during the starting of the engine until a prescribed engine speed is reached, said second valve means being locked in a position to render said actuating means operative thereafter until the engine is substantially stopped.

31. A fuel injection pump according to claim 30 including a shut-off valve controlling the supply of fuel to said charge pump and a hydraulic actuator therefor, said means for rendering said actuating means inoperative being effective to connect said hydraulic actuator to said source of fuel under pressure to close said shut-off valve in the event of the malfunction of said means for rendering the actuating means inoperative.

32. A fuel injection pump according to claim 29 including a shut-off valve controlling the supply of fuel to the charge pump and a manually operable throttle for setting the speed of the engine, said manually operable throttle being operatively connected to said shut-off valve to manually close the valve.

33. A fuel injection pump according to claim 1 including damping means for damping the movement of said second piston in a direction indicative of increased fuel above a predetermined level of fuel delivery.

34. A fuel injection system having a control system for regulating the quantity and timing of the delivery of fuel to an associated engine, said control system comprising three pistons respectively slidably mounted in parallel bores, a source of fuel under pressure, means for selectively supplying fuel from said source to actuate each of said pistons, means for generating a varying control signal correlated with engine speed, means responsive to said varying control signal to control the delivery of fuel from said source to actuate the first of said pistons to a position indicative of engine speed, means for controlling the delivery of fuel from said source to actuate the second of said pistons to a position indicative of the quantity of fuel delivered by the pump, and means interconnecting said first and second pistons with each other with the third piston for controlling the delivery of fuel from said source to actuate the third piston to a position for controlling the timing of delivery of fuel by the pump in response to the axial positions of said first and second pistons.

35. A fuel injection pump according to claim 34 wherein said first and second pistons are each provided with a cam surface having a cam follower engageable therewith, said interconnecting means comprises a beam, the ends of said beam respectively engaging said cam followers to adjust the lateral position of said beam according to the profile of said cam surfaces, and a valve is operatively connected to an intermediate point of said beam for controlling the delivery of fuel of said source to actuate said third piston.

36. A fuel injection pump according to claim 35 wherein said second piston is provided with a second cam surface including a governor controlled valve for controlling the delivery of fuel from said source to actuate said second piston upon a change of speed of the associated engine from a preset speed, a cam follower engageable with said second cam surface of said second piston for actuating a feedback control for said governor controlled valve to discontinue the actuation of said second piston when the preset speed is re-established.

37. A fuel injection pump according to claim 36 wherein said first piston is provided with a second cam surface including a cam follower engageable with said second cam surface of said first piston and is operatively connected to override said governor controlled valve and set a maximum limit of the fuel delivered to the engine at varying levels according to engine speed.

* * * * *